US005609785A

United States Patent [19]

Sallinen et al.

[11] Patent Number: 5,609,785

[45] Date of Patent: Mar. 11, 1997

[54] METHOD AND APPARATUS FOR IMPROVING THE PERFORMANCE OF A HEATING FURNACE FOR METAL SLABS

[75] Inventors: Johannes Sallinen; Pekka Mäntylä, both of Siikajoki, Finland

[73] Assignees: Acon Finland Oy Ltd., Siikajoki; Rautaruukki Oy, Oulu, both of Finland

[21] Appl. No.: 403,751

[22] PCT Filed: Dec. 23, 1992

[86] PCT No.: PCT/FI92/00357

§ 371 Date: May 11, 1995

§ 102(e) Date: May 11, 1995

[87] PCT Pub. No.: WO94/08190

PCT Pub. Date: Apr. 14, 1994

[30] Foreign Application Priority Data

Oct. 5, 1992 [FI] Finland ..... 924469

[51] Int. Cl.[6] ..... F27B 9/12; F27B 9/36

[52] U.S. Cl. ..... 219/388; 432/202; 266/121

[58] Field of Search ..... 219/388; 392/417; 432/148, 171, 202; 266/108, 121, 261

[56] References Cited

U.S. PATENT DOCUMENTS

| | | | |
|---|---|---|---|
| 4,125,365 | 11/1978 | Nelson . | |
| 4,229,163 | 10/1980 | Shinohara | 432/202 |
| 4,266,932 | 5/1981 | Shinohara | 432/202 |
| 4,299,565 | 11/1981 | Shinohara . | |
| 4,388,068 | 6/1983 | Takeuchi et al. | 432/122 |
| 4,745,252 | 5/1988 | Roth et al. . | |
| 5,156,800 | 10/1992 | Buchet et al. . | |

FOREIGN PATENT DOCUMENTS

| | | |
|---|---|---|
| 0170585 | 2/1986 | European Pat. Off. . |
| 2656553 | 7/1991 | France . |
| 2358799 | 9/1974 | Germany . |
| 58-213827 | 12/1983 | Japan . |
| 60-226690 | 11/1985 | Japan . |
| 2048440 | 12/1980 | United Kingdom . |
| 2099120 | 12/1982 | United Kingdom . |

*Primary Examiner*—Teresa J. Walberg

*Attorney, Agent, or Firm*—Burns, Doane, Swecker & Mathis LLP

[57] ABSTRACT

The invention relates to a method and apparatus for improving the performance of a heating furnace for metal slabs. The elongated heating furnace includes a water cooled conveyor track for carrying metal slabs through the heating furnace and at least one fossil-fuel operated burner for heating metal slabs. The heating furnace includes a convection zone wherein metal slabs are heated primarily by the action of convection heat delivered by combustion gases driven therethrough, and a heating zone wherein metal slabs are heated primarily by the action of radiation heat emitted by the burner located therein. In addition, the metal slabs are heated by at least one radiant heater which is positioned at a location spaced apart from said burner in the longitudinal direction of the heating furnace for reducing the depthwise temperature differences developing in the metal slabs in the heating furnace and/or for increasing the capacity of the heating furnace.

26 Claims, 6 Drawing Sheets

FIG. 3
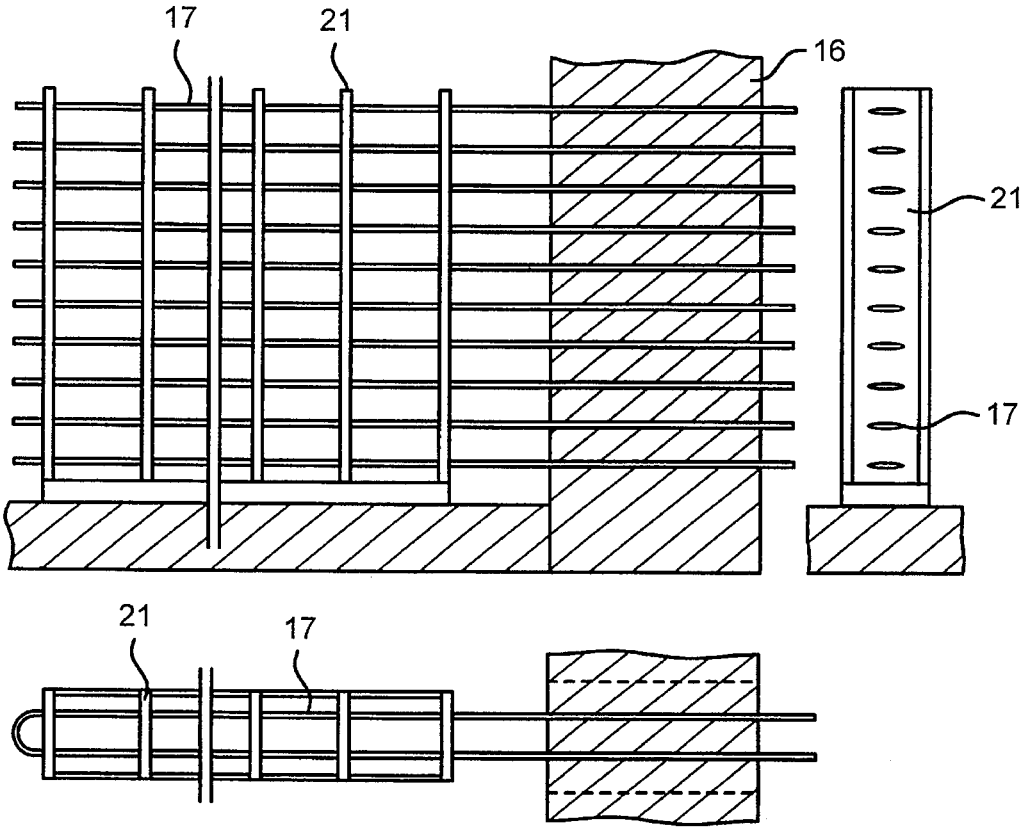
FIG. 4
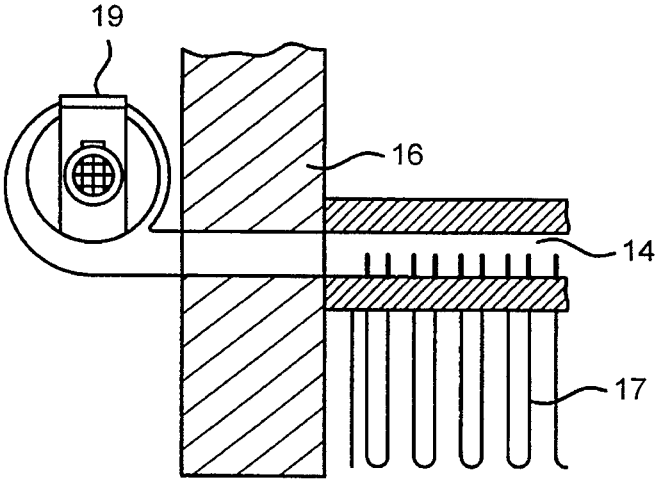
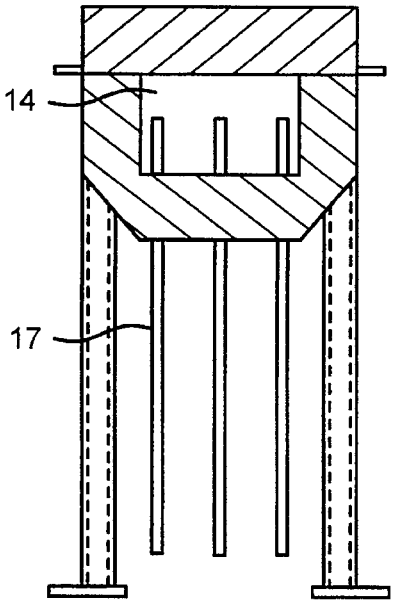
FIG. 5

FIG. 7
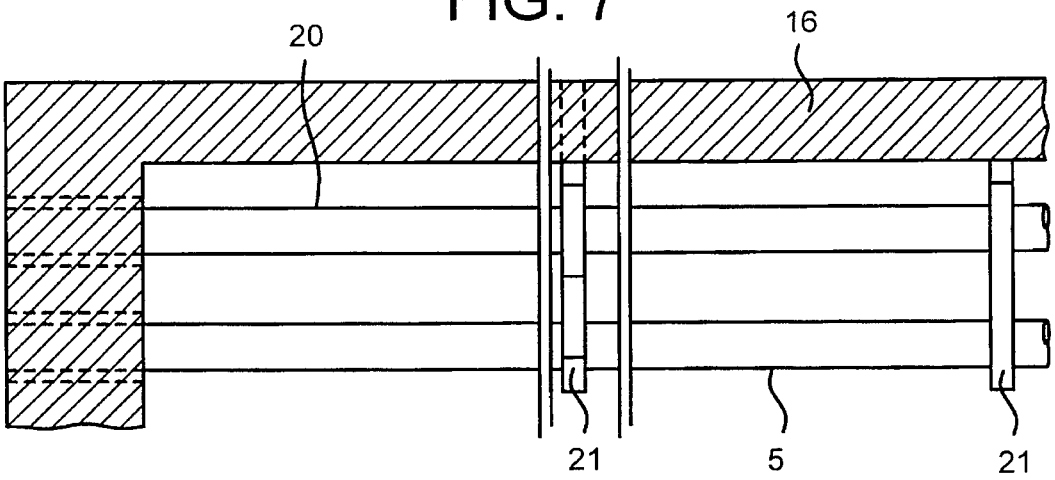
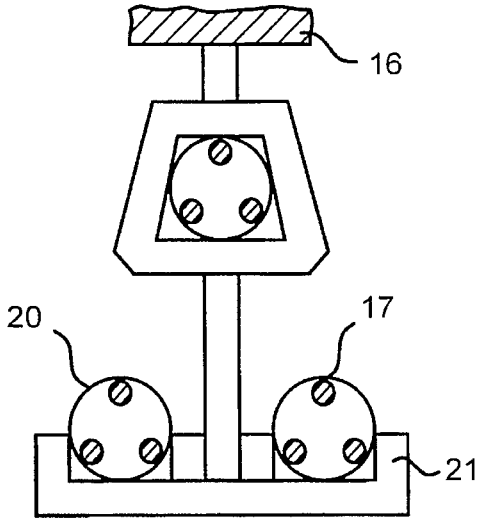
FIG. 6
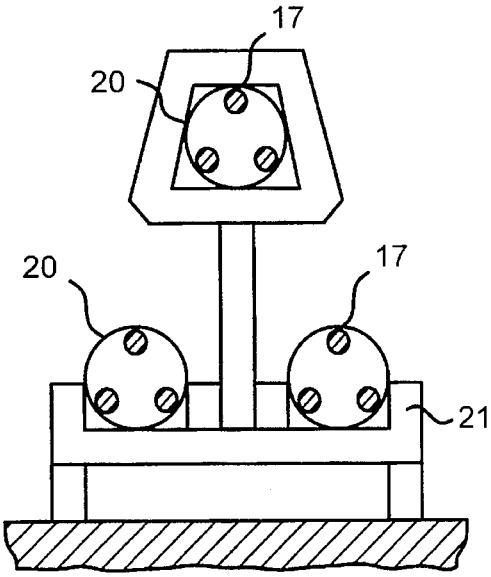
FIG. 8

METHOD AND APPARATUS FOR IMPROVING THE PERFORMANCE OF A HEATING FURNACE FOR METAL SLABS

BACKGROUND OF THE INVENTION

The present invention relates to a method for heating metal slabs in an elongated heating furnace. The invention relates also to an elongated heating furnace for heating metal slabs.

The purpose of heating metal slabs is to bring about a proper temperature for metal slabs to be rolled or otherwise moulded. For example, steel slabs are heated prior to a rolling operation to the temperature of appr. 1100°–1200° C. in order to make them sufficiently mouldable. For heating, the slabs are carried into a heating furnace by means of suitable equipment. The heating furnace is an elongated and usually a brickmasoned structure which is heated with suitable burners. The temperature profile of a heating furnace is selected to be such that, upon leaving the heating furnace, the slabs have a desired temperature. In this context, the term temperature profile is defined as referring to the temperatures of the furnace and slabs contained in the furnace at a certain instant of time. The furnace has its own temperature profile. Respectively, the slabs have their own temperature profile at each point in the direction of thickness. Thus, if the temperature profile of a heating furnace is known, the temperature at each point within the furnace is also known. If the temperature profile of a certain point, e.g. that of the surface of a slab, is known, the surface temperature of the slab will be known at each point in the longitudinal direction of the heating furnace.

A typical heating furnace for metal slabs is divided into three zones, the first zone being a so-called convection zone which is the first to take up the slabs. This is followed by a so-called heating zone which accommodates burners operating on a fossil fuel, i.e. gas or oil. The final zone in the traveling direction of the slabs is a so-called equalizing zone, wherein temperature of the slabs is allowed to equalize. The heating furnace operates in a manner that the combustion gases from burners firing in the heating zone are conveyed upstream relative to the traveling direction of the slabs from the heating zone to the convection zone. Thus, the burners are located in the rear section of the heating zone and a chimney in the front section of the convection zone. With an arrangement like this, a temperature difference between the combustion gas and the slab is significant at each point in the lengthwise direction of a furnace so as to provide a heat transfer as effective as possible from combustion gas to slab. In the convection zone, the transfer of heat from combustion gas to slab occurs through convection, as suggested by the name of this zone.

U.S. Pat. No. 4,299,565 discloses a heating furnace wherein metal slabs are heated by fuel combustion flames. Heat transfer converters each made of a heatresistant material are disposed downstream of the flow of the combustion flames in the convection zone of the furnace. These converters are heated through convection heat transfer from a high temperature and high speed flow of the combustion flames and combustion gas. The purpose of the converters is to raise the thermal efficiency of the furnace by utilizing the heat that otherwise would be lost along with the discharging combustion gases.

Patent application GB 2 048 440 discloses a heating furnace for metal slabs, wherein the metal slabs are heated by using a plurality of burners and radiant heaters located one below another and at equal distances over the entire furnace length. The cited heating furnace is primarily intended for use in the bright annealing of copper under a shielding atmosphere. In bright annealing, a copper product is heated in a reducing atmosphere for removing an oxide layer from the product surface and for producing a bright surface. The purpose of the burner is not only the production of heat but also the production of a reducing atmosphere. The fuel comprises e.g. natural gas or other pure hydrocarbon and the combustion is effected with depleted oxygen for the production of reducing gases, such as carbon monoxide and hydrogen. These gases remove the oxide layer of the surface and brighten the surface. This is followed by cooling the product prior to its discharge from the furnace. It should also be noted that the furnace does not include a convection zone and the combustion gases are discharged from both ends of the. furnace. The furnace has such a temperature profile that temperature is at its highest in the middle of the furnace and becomes lower towards each end. The metal products are carried upon rollers. This type of furnace is not suitable e.g. for heating steel slabs intended for subsequent rolling.

The above-described prior art heating furnaces for metal slabs have several functional deficiencies. Especially, the heating furnaces generally used by the steel industry have a temperature profile which is "inflexible" and also highly dependent on the furnace geometry. Therefore, an effort is made to maintain the temperature profile of a heating furnace as constant as possible. It is prior known that the performance of a heating furnace is very difficult to control by the regulation of burners and, thus, the temperature profile of a furnace cannot be changed in a sufficiently flexible fashion. The furnace capacity is determined on the basis of the thickest slab. A flexible regulation of the temperature profile would be a particularly important feature whenever the metal slabs loaded into a heating furnace have varying thicknesses. Another deficiency found in the prior art heating furnaces is that the increase of capacity without major structural modifications is not generally possible. If the capacity of a heating furnace is to be increased, this could be effected e.g. by extending and/or lowering the furnace, increasing the number of burners or by other such measures. Structural changes are generally required and those are very expensive to carry out. In addition, such measures usually deteriorate the furnace efficiency.

An object of the invention is to provide a method and a heating furnace for eliminating the above drawbacks. Thus, an object is to provide a heating method and an improved heating furnace, e.g., in a manner that the temperature profile of a heating furnace can be flexibly regulated. In addition, it is necessary that the method and the improved furnace can be used for raising the capacities of prior art heating furnaces without major structural modifications thereto.

A method of the invention improves the performance of a heating furnace particularly for the reason that a temperature difference between the top and bottom surface as well as between the top and bottom surfaces and the mid-section of metal slabs decreases without having to reduce the capacity. The reason for this is that a properly positioned radiant heater is capable of providing a rapid heat transfer and, thus, temperature of a metal slab rises at an earlier stage. The equalizing time of temperatures will be longer and the temperature differences within a slab will be reduced. This will improve the rollability of a metal slab as well as the internal quality of a product. This also facilitates the production of thinner hot-rolled products, which offers a major economic benefit as some of the expensive cold-rolling can be replaced this way. The uniformity of slab temperature is of major importance e.g. in terms of the smooth dissolution of alloy materials contained in metal, which in turn affect the mechanical and other properties of the product. In addition, the temperature differences of a slab have an effect on metallurgical phenomena occurring in a slab as well as on the stress condition, which has significant effects on the properties obtained for a product in a rolling operation.

A properly positioned radiant heater is also capable of reducing the lengthwise temperature differences appearing in a metal slab. This facilitates particularly the rolling of thin webs.

A method of the invention can be used for lowering the heating temperature of metal slabs without having to reduce capacity. Lowering of the heating temperature improves the mechanical properties of certain rolled products while affording the possibility of reducing the amount of alloy materials. This leads to an improved weldability and a more economical product.

With a traditional heating furnace, said temperature drop means automatically a reduction of capacity. A method and an apparatus of the invention can be used for decreasing or increasing the furnace temperature in a flexible manner without changing the regulating parameters of a furnace.

With a method of the invention it is also possible to increase the capacity of the heating furnace by 25% while decreasing the total energy consumption by 10% and the consumption of fossil fuels by 35%.

A method of the invention also facilitates a slab-by-slab regulation of the slab temperature profile. It is possible to use thicker slabs in the heating furnace without compromising the heating capacity and thus to increase the coil weight. This has a major economic significance in terms of the further processing in a steel works.

BRIEF DESCRIPTION OF THE DRAWINGS

The invention will now be described in more detail with reference made to the accompanying drawings, in which FIG. 3 shows a frame structure for the electric resistance elements of a radiant heater to be mounted on the floor or ceiling of a heating furnace, FIG. 4 shows a frame with a ventilation duct for the electric resistance elements of a radiant heater, FIG. 5 shows the radiant heater of FIG. 4 mounted on the floor of a heating furnace, FIG. 6 shows a frame to be suspended from the ceiling of a heating furnace with the heating elements fitted inside protective tubes, FIG. 7 shows the radiant heater of FIG. 6 in a plan view, FIG. 8 shows the radiant heater of FIG. 6 mounted on the floor of a heating furnace, FIG. 9 a frame for metallic resistance strip elements, serving as a radiant heater and to be suspended from the ceiling of a heating furnace.

DETAILED DESCRIPTION OF THE PREFERRED EMBODIMENTS

Figure 1:
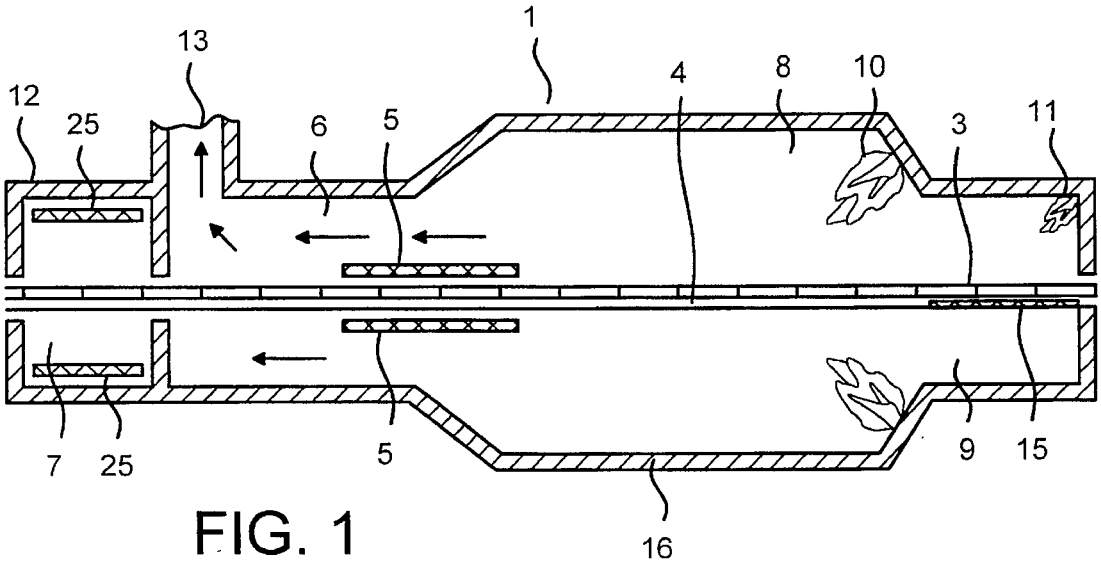
FIG. 1 shows a basic side view of a fossil-fuel operated heating furnace for metal slabs, provided with radiant heaters in accordance with the invention.

FIG. 1 illustrates a typical heating furnace 1 for metal slabs, fitted with modifications required by a method of the invention. FIG. 1 is a lengthwise cross-sectional view, wherein a stream of slab stock comprising a plurality of successive metal slabs 3 advances from left to right through the heating furnace 1. In a very typical case, the heating furnace 1 has a length of 30 m, a width of 8 m, and a height of 2–4 m. Respectively, the metal slab 3 has typically a length of 6.5 m, a width of 1.8 m, and a thickness of 0.21 m.

Metal slabs 3 are carried along conveyor tracks 4 which can be water-cooled. Metal slabs 3 advance in flat position and transversely relative to the advancing direction and the shifting movement is achieved by pushing metal slabs 3 from outside the furnace along said water-cooled tracks 4 or by using stepped-beam or other equipment. Metal slabs 3 are first carried into a preheating zone 7, which is provided with radiant heaters 25 on the opposite sides, i.e. above and below the slabs. These radiant heaters 25 can be installed without protective cases as they shall not be exposed to combustion gases. After this, metal slabs 3 proceed into a convection zone 6 and, are exposed to a hot combustion gas and, therefore, radiant heaters 5 possibly included in this zone 6 are generally provided with a case. In certain cases, however, they can be installed without cases.

From the convection zone 6 said metal slabs 3 advance into an actual heating zone 8, which houses fossil-fuel operated burners 10. The heating zone 8 or, as shown e.g. in FIG. 1, the transitional area between the convection zone 6 and the heating zone 8 is provided with two radiant heaters 5 on the opposite sides of the traveling passage for metal slabs. The radiant heaters 5 can be fitted with an enclosure. One radiant heater is located above and the other below the stream of slab stock. They can also be located on the opposite sides of the traveling passage for metal slabs 3. The radiant heaters 5 are preferably located before the burners 10 in the advancing direction of metal slabs. As will be described later, it is especially preferable to locate radiant heaters 5 in a position before the area of the most powerful radiation intensity caused by burners 10. From the heating zone 8, said metal slabs 3 proceed into an equalizing zone 9, which is also provided with two smaller burners 11 as well as two radiant heaters 15. These radiant heaters 15 are located in the crosswise direction of metal slabs 3 as an extension to water-cooled tracks 4 of the heating zone 8 in recesses provided below metal slabs 3 on the grate of said equalizing zone 9. The purpose of this arrangement is to remove from metal slabs 3 the marks caused by water-cooled conveyor tracks 4, i.e. the cooled spots.

FIG. 1 shows clearly the geometric shape of heating furnace 1. The heating zone 8 has more height and length than the other zones, since in this zone the heat transfers from the flames of burners 10 to metal slabs 3 through radiation. On the other hand, in the convection zone 6 the heat transfers from combustion gas to metal slabs 3 through convection. The passage of combustion gases is indicated by arrows in FIG. 1. Thus, it is important that the combustion gases come into contact with metal slabs 3, and therefore said convection zone 6 is designed to be shallow. As pointed out earlier, the combustion gases are discharged from the front section of the convection zone 6 through a discharge duct 13 and further through a chimney.

The heating furnace 1 shown in FIG. 1 differs from a traditional heating furnace 1 for metal slabs in three respects. The first difference is that said heating furnace 1 is preceded by a preheating chamber 12, designed to provide a preheating zone 7. It is fitted with non-enclosed radiant heaters 25. This zone 7 has a length of 5 –12 m, depending on a desired increase in capacity. The second difference consists of radiant heaters 5, some of which are located partly within the rear section of convection zone 6 and partly within the front section of heating zone 8. At this point, in normal situations, i.e. without a radiant heater 5, the depthwise temperature gradient of a metal slab begins to grow significantly. The third difference is that the equalizing zone 6 is provided with radiant heaters 15 located below metal slabs. These modifications to a traditional heating furnace 1 have increased the capacity while improving the controllability of heating furnace 1. It should be noted that all radiant heaters 5, 15, 25 are located in the longitudinal direction of the heating furnace at a distance from the burner 10. This is the only way of reducing the depthwise temperature differences or, alternatively, of increasing the heating furnace capacity. It should be appreciated that, if necessary, said radiant heaters 5, 15, 25 can be positioned below and/or above, on either side or both sides of metal slabs.

The radiant heaters 5 comprise metallic or ceramic resistance materials. The most common ceramics are SiC and $MoSi_2$. If necessary, the resistances can be enclosed with a thermally conductive material for preventing mechanical and chemical damages. Enclosing the radiant heaters 5 with flat sheets reduces significantly the transfer of heat directly from resistances to combustion gas, which is an advantage as otherwise most of the heat would be wasted along with the combustion gas. The reason why flat sheets reduce the transfer of heat to the combustion gas is that the flow of combustion gas relative to a flat sheet occurs in a laminar fashion, whereby the transfer of heat is reduced as compared with a corresponding turbulent flow. The protection with a flat sheet reduces substantially the dissipation loss transferring from a heat source to combustion gas, since such protection makes the gas flow less turbulent than what would be the case if the flow should occur e.g. directly past round resistance rods. Also the fact that the surface temperature of a radiating sheet is lower than that of resistance elements 17 contributes towards the same effect. Thus, casing of radiant heaters 5 not only protects the resistance rods but also has a beneficial effect on the performance of radiant heaters 5. Casing can accomplished either in a manner that the case insulates the resistance hermetically from combustion gases or that the case insulates the resistance mechanically from the combustion gas flow.

The heat transfer capacity of radiant heaters 5 operating on the radiation principle increases in the fourth power of the radiation surface temperature. When the heat emitting surfaces have a temperature of more than 1000° C., the coefficient of heat transfer will be appr. 150–300 $W/m^2/°$ C. Such a coefficient of heat transfer means that the furnace capacity can be significantly increased.

Figure 2:
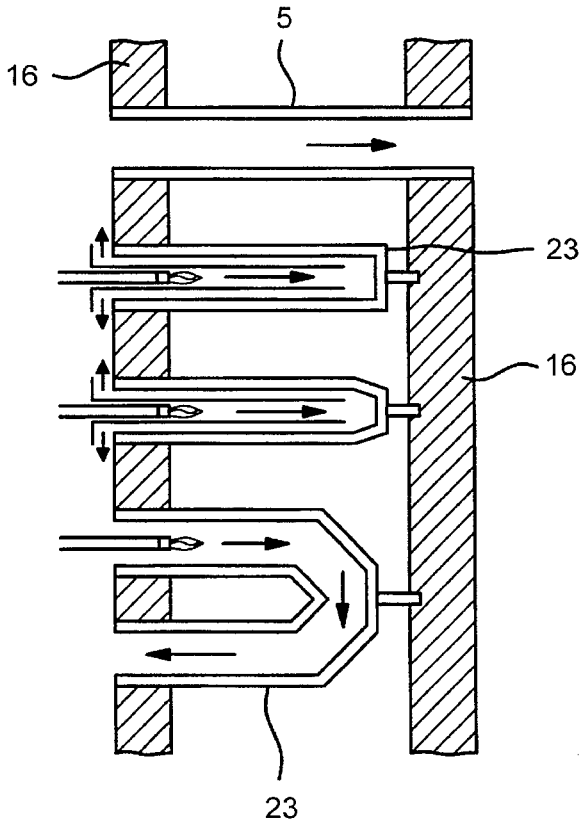
FIG. 2 illustrates a variety of combustion tubes to be fitted in a heating furnace for metal slabs, heated with a fossil fuel and serving as radiant heaters.

FIG. 2 illustrates combustion tubes 23 which can be used as radiation heat sources in the heating furnace 1. As suggested by their name, said combustion tubes 23 are substantially tubular radiant heaters 5 which are insulated from the furnace space and heated by means of burners. As shown in FIG. 2, the combustion tube 23 may contain inner tubes for controlling the flame. The combustion tube 23 may comprise a pipe, extending through heating furnace 1 and fitted with a burner at one end thereof or it can be a substantially U-shaped pipe, having a burner at one end thereof and discharging the combustion gases of the burner through the other end. The combustion tube 23 can be made of fire-resistant steel, SiC or other such material.

FIG. 3 illustrates one possibility of housing $MoSi_2$—resistance elements 17 inside heating furnace 1. Resistance elements 17 are in the shape of U and, thus, a single resistance element 17 requires two inlets in a furnace wall 16. In the furnace, a resistance element 17 is supported by a ceramic frame structure. A single radiant heater 5 comprises approximately ten resistance elements 17, placed one above another in said frame structure. In the case shown in FIG. 3, a supporting frame 21 is positioned on the floor of a furnace but it can also be mounted on the ceiling of a furnace by using a suitable suspension. The resistance radiator of FIG. 3 has a length of 3,4 m, a height of 0,90 m, and a width of 0,18 m.

FIG. 4 illustrates a supporting frame 21 for $MoSi_2$elements. This supporting frame 21 is characterized by suspending U-shaped resistance elements 17 from a switch box 14. Thus, the switch box 14 provides a continuous space, which is separate from combustion gas and can be ventilated by means of a fan 19. The switch box 14 can be suspended from the ceiling of heating furnace 1 or the switch box 14 can be provided with legs that are mounted on the grate of a furnace. An advantage offered by this design is that the furnace wall 16 does not require individual inlets for each resistance element 17. The switch box 14 and resistance elements 17 suspended therefrom create a readily portable unit whose installation in heating furnace 1 requires just one inlet on the opposite sides of a furnace for the switch box 14 cooling air. The box can be made of a fire-resistant sheet metal or SiC and the heat insulation can be obtained by using a ceramic fiber. FIG. 5 illustrates a design with a radiant heater 5 mounted on the floor.

FIGS. 6, 7 and 8 illustrate a supporting frame 21 for resistance elements 17 fitted inside protective tubes 20. The protective tube 20 is made e.g. of a fire-resistant metal or SiC. The resistance elements 17 are either $MoSi_2$ resistance elements, metallic or SiC resistance elements. On the other hand, the supporting frame 21 is made e.g. of a fire-resistant metal. The supporting frames 21 are placed inside a furnace at suitable intervals and, in the case of FIGS. 6, 7 and 8, the supporting frame 21 is capable of carrying three protective tubes 20. In FIGS. 6 and 7, said supporting frame 21 is suspended from the ceiling and in FIG. 8 it is mounted on the floor of heating furnace 1.

Figure 9:
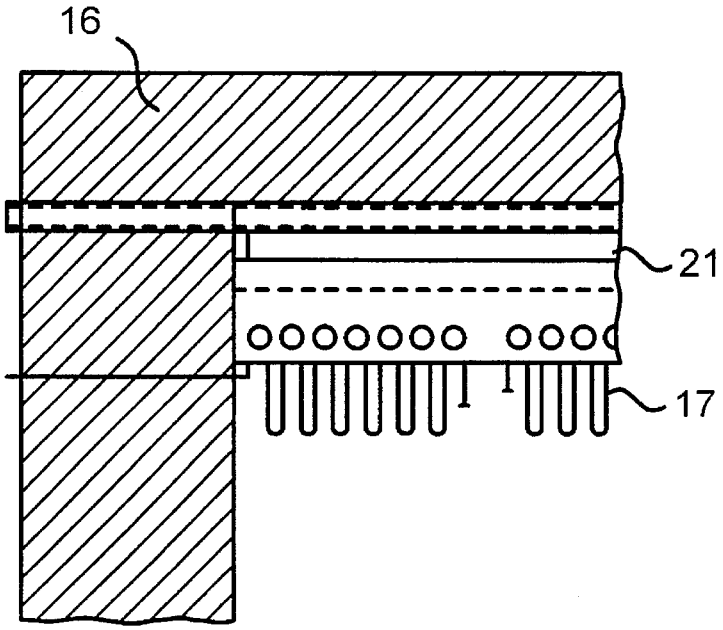
Figure 10:
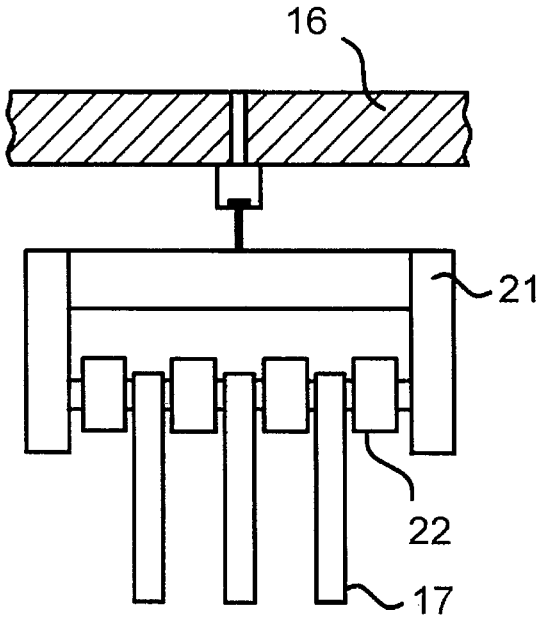
FIG. 10 shows the radiant heater of FIG. 9 in an end view.

FIGS. 9 and 10 illustrate a supporting frame 21, which is suitable for metallic resistance strip elements 17 and can either be suspended from the ceiling or mounted on the floor. The supporting frame 21 includes a ceramic or metallic supporting bracket and a ceramic or metallic supporting bar with corrugated metallic resistance elements 17 suspended from the latter. Between elements 17, the bar is designed to carry ceramic insulating sheets 22.

A radiant heater 5 located in heating furnace 1 can be provided with sensors monitoring the surface temperature of a metal slab 3, such as pyrometers, infrared meters, thermoelements etc., as well as with control circuits for switching on the power in case the surface temperature of a metal slab 3 within the range of radiant heater 5 is lower than a desired set value. Respectively, the heating effect is switched off if the surface temperature of metal slab 3 has reached a desired value. Thus, it is possible to achieve control of the furnace operation on slab-by-slab basis, i.e. based on the temperature of an individual slab. Hence, the temperature profile can be flexibly regulated, for example whenever the metal slabs have varying thicknesses.

EXAMPLE 1

The STEELTEMP program is a computer program generally applied by the Nordic steel industry and it can be used for calculating e.g. the temperature development and thermal stresses as a function of time and place in heating furnace 1. This software can be used e.g. for finding the best locations for resistance radiators in heating furnace 1 in view of obtaining the best possible increase in capacity. The calculations effected with this software indicated that a radiant heater is capable of improving the temperature profile of heating furnace 1. The installation of a radiant heater 5 with an power of 5000 kW in metal slabs heating furnace 1 with a capacity of 100 tn/h resulted in a 25% increase of capacity. If a corresponding capacity increase had been carried out with fossil fuels, the result would have been the overheating of slabs in the heating zone of a furnace. As known in the art, overheating leads to two consequences. First of all, a locally occurring grain growth which leads to a highly detrimental "orange surface" in rolling and, secondly, in an overheated state, the material of a steel slab, for example, reacts vigorously with the sulphur contained in fuel and in combustion gas. The sulphur additives attach firmly to the slab surface and this shows as surface defects in rolled products.

The calculations carried out with said program indicated also that the temperature of slabs was considerably more uniform. Thus, temperature differences between the top and bottom surfaces as well as the mid-sections of slabs were reduced from 50°–150° C. to 10°–20° C. after fitting said heating furnace 1 with radiant heaters. Without such heaters, the corresponding reduction of temperature gradient would only be possible by cutting down capacity.

According to STEELTEMP simulations, the total power demand of a furnace with a capacity of 100 tn/h was reduced by 10% while the amount of fossil fuel was reduced by 35% after fitting a 5 MW radiant heater 5 in the furnace at a precisely determined location. Thus, the radiant heater 5 reduces energy consumption while considerably cutting down the environmetal pollution load caused by a production plant.

The physical explanation for the above energy savings is the fact that radiant heaters are capable of operating at temperatures even lower than that of a flowing combustion gas when the surface temperature thereof exceeds the temperature of an advancing stream of slab stock. This is due to a physical fact that energy only transfers from a higher temperature to a lower temperature.

Hence, it may be the most preferable solution to employ such a radiant heater temperature which is equal to or just slightly above that of a combustion gas. In such conditions, no thermal energy at all can transfer to a combustion gas or the amount of transferring energy is very slight. Since the furnace walls have a temperature which in practice is very close to that of combustion gases, the transfer of heat from radiant heaters to furnace walls is also very slight. The only direction with any practical transfer of heat is towards the slabs to be heated. This is why the radiant heaters are capable of achieving a very high efficiency.

EXAMPLE 2

Figure 11:
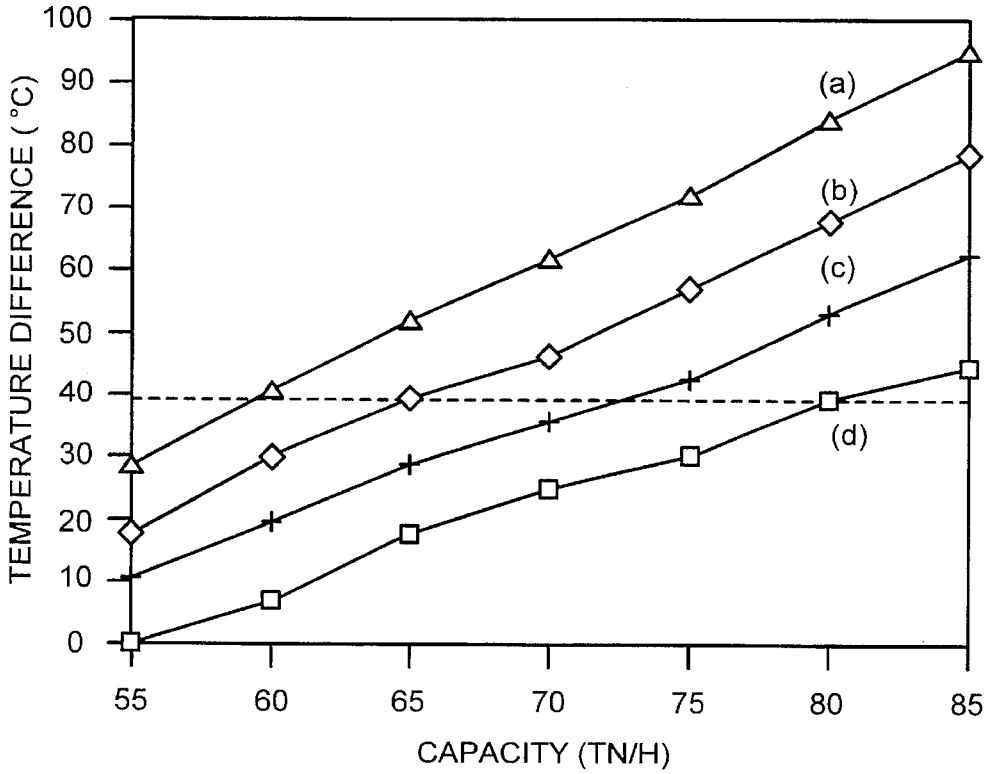
FIG. 11 shows calculated temperature differences for metal slabs at the end of an equalizing zone as a function of the capacity of a heating furnace on a variety of thicknesses for metal slabs.
Figure 12:
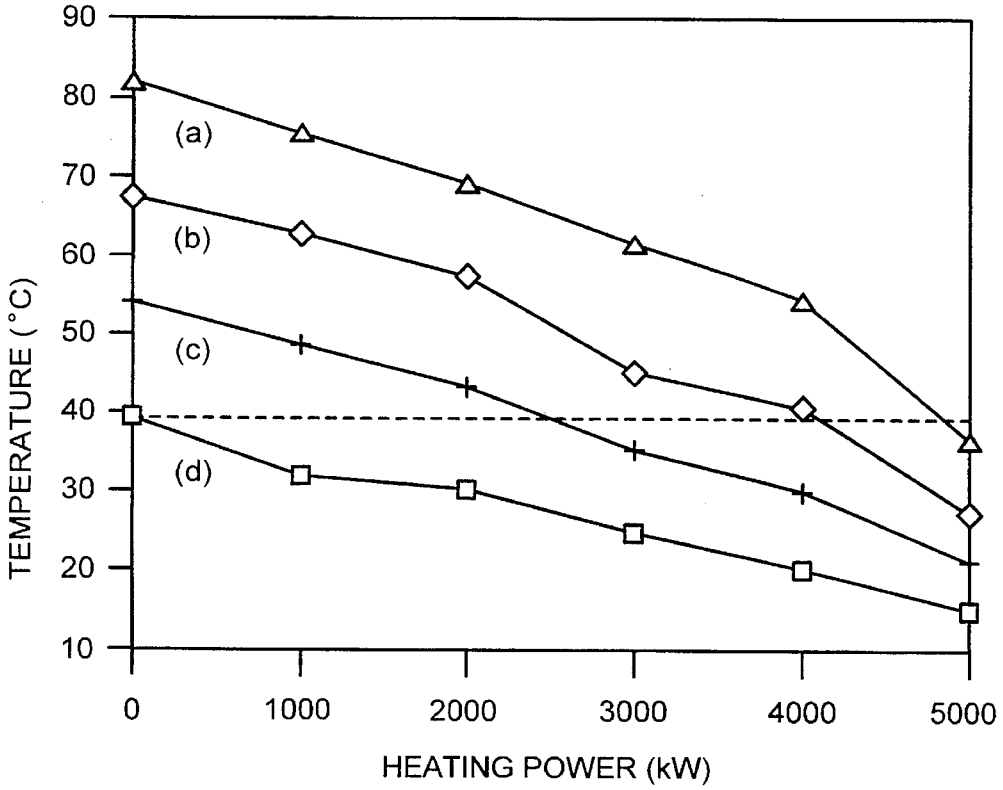
FIG. 12 shows calculated temperature differences for metal slabs at the end of an equalizing zone as a function of the power of a radiant heater located in a heating furnace according to the invention on a variety of thicknesses for metal slabs.

FIGS. 11 and 12 illustrate temperature differences between the top and bottom surfaces of metal slabs 3 calculated for one heating furnace 1 at the rear end of an equalizing zone 9. In FIG. 11, the results are shown in a set of curves as a function of capacity. The capacity is presented as a stream of slab stock or in units tn/h. Each curve corresponds to a certain thickness of metal slab 3 in a manner that the thicknesses of metal slabs 3 are: (a) 270 mm, (b) 250 mm, (c) 230 and (d) 210 mm. The horizontal dotted line drawn in the middle of FIG. 11 represents a temperature difference (39° C.) used as a reference value and obtained for metal slab 3 with a thickness of 210 mm in heating furnace 1 having a capacity of 80 tn/h. The thicker a slab the greater is the temperature difference between the top and bottom surfaces at the rear end of equalizing zone 9 included in the heating furnace 1. A result of this is that, if the purpose is to use heating furnace 1 for thicker metal slabs 3 and yet to maintain the same final temperature difference (e.g. 39° C.), the furnace capacity must be decreased. Thus, for metal-slabs 3 having a thickness of e.g. 270 mm it is only possible to use a capacity of 60 tn/h. On the other hand, if the purpose is to maintain the nominal capacity of 80 tn/h with thick metal slabs 3, the temperature difference at the rear end of equalizing zone 9 will be appr. 100° C. Such a temperature difference impairs substantially the quality of a product to be rolled.

EXAMPLE 3

FIG. 12 illustrates the calculated results for a temperature difference between the top and bottom surface of metal slab 3 at the rear end of the equalizing zone 9 as a function of the power of the radiant heater 5. According to the invention, said radiant heater 5 is located at the front section of the heating zone 8. If a 5 MW radiant heater 5 is used, the temperature difference between the top and bottom surfaces of a 210 mm thick metal slab 3 at the rear end of equalizing zone 9 is reduced to appr. 15° C. Respectively, when using 270 mm thick metal slabs 3, said temperature difference is equal to or slightly less than the temperature difference of a 210 mm thick sheet used as a reference value in a reference furnace. Thus, the set of curves shown in fig. 12 indicates that, when using a radiant heater 5 of the invention, it is possible to use one and the same heating furnace 1 for heating thicker metal slabs 3 without having to reduce capacity. Respectively, if the thickness of metal slabs 3 in heating furnace 1 remains unchanged, said radiant heaters 5 are capable of producing a considerably smaller temperature difference, which in turn improves the quality of a rolled product.

EXAMPLE 4

Figure 13:
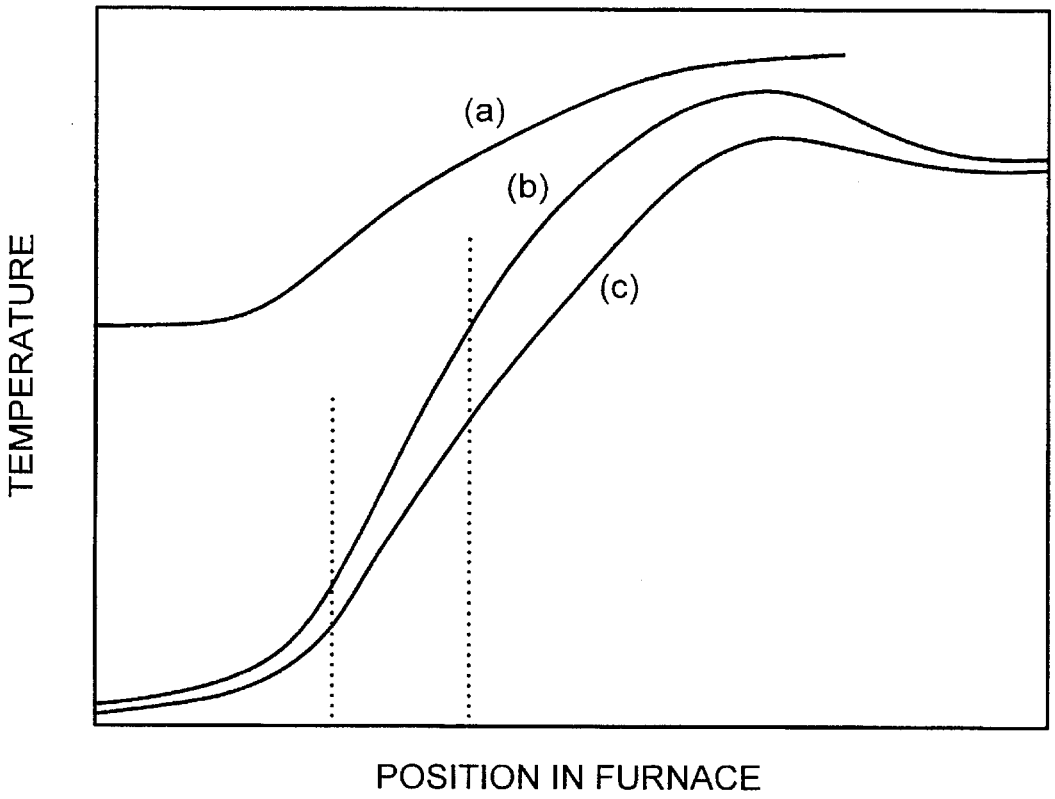
FIG. 13 shows diagrammatically temperature profiles for a heating furnace and the top and bottom surfaces of a metal slab.

FIG. 13 illustrates diagrammatically the temperature profiles of a typical heating furnace in normal conditions, i.e. in a conventional operating situation without radiant heaters. The temperature profiles are indicated as a function of a longitudinal position coordinate in the furnace. Curve (a) represents the temperature profile of a furnace, curve (b) represents the temperature profile of the top surface of metal slab 3, curve (c) the temperature profile of the bottom side of metal slab (3). A characterizing feature in the temperature profile of metal slab 3 is that, in the front section of the furnace, the rise of temperature is very slight. In a furnace, this section corresponds essentially to the convection zone 6. Upon the arrival in the heating zone 8, the radiant heat emitting from burner 10 commences the direct heating of metal slab 3. The most intense heating occurs at the top surface. Instead, the temperature profile of the bottom surface follows a little behind. Over this section of the curve, the depthwise temperature gradient of metal slab 3 begins to grow significantly. Specifically, the temperature gradient refers to derivate dT/dx, wherein x=a depthwise coordinate of metal slab 3 and T=T(x) is the temperature of metal slab 3 expressed as a function of x. The temperature gradient is at its peak at the reversing point of curves (b) and (c) in FIG. 13. When reaching a position very close to burner 10, the temperature of metal slab 3 rises to its maximum value. After the of burner 10, the temperature of metal slab 3 begins to fall and, upon the arrival in the equalizing zone 9, the temperature drops further to a desired final temperature while the temperature difference between top and bottom surface is reduced. The dotted lines in FIG. 13 indicate a range, within which the temperature gradient grows vigorously and within which a radiant heater 5 can be located.

EXAMPLE 5

In one heating furnace 1 it was possible to indicate mathematically that the loss of capacity in a combustion gas was 344 kW when element 17 was not insulated from combustion gas and just 157 kW when elements 17 were insulated from combustion gas by means of enclosures. In this case, although the question was about a relatively small radiant heater 5, a considerable annual saving was achieved by carrying out the insulation of radiant heaters 5 from combustion gas by means of cases.

We claim:

1. Method for heating metal slabs in an elongated heating furnace, said heating furnace including means for carrying metal slabs through the heating furnace and at least one fossil-fuel operated burner for heating the metal slabs, said heating furnace further including a convection zone without burners wherein the metal slabs are heated primarily by the action of convection heat delivered by combustion gases driven therethrough, and a heating zone wherein the metal slabs are heated primarily by the action of radiation heat emitted by the fossil-fuel operated burner which is located therein, comprising the steps of:

heating the metal slabs by at least one active radiant heater positioned at a location before said fossil-fuel operated burner in an advancing direction of the metal slabs in the convection zone or in the heating zone; and then heating the metal slabs by the action of radiation heat emitted by said fossil-fuel operated burner in the heating zone.

2. The method as set forth in claim 1, wherein the radiant heater is used for heating at a location in which a depthwise temperature gradient of the metal slabs begins to grow.

3. The method as set forth in claim 1, wherein the metal slabs are heated by means of the radiant heater, which is located therebelow.

4. The method as set forth in claim 1, wherein the radiant heater comprises a resistance element transforming electric energy into heat or a combustion tube which is heated from inside by means of a burner.

5. The method as set forth in claim 4, wherein the radiant heater is provided with a case for protecting the resistance element from combustion gases.

6. The method as set forth in claim 1, wherein the temperature of the radiant heater is adjusted to be substantially equal to that of the combustion gas for preventing the transfer of heat from the radiant heater to the combustion gas.

7. The method as set forth in claim 1, wherein the heating power of the radiant heater is arranged to be adjustable on the basis of the surface temperature of metal slabs.

8. An elongated heating furnace for heating metal slabs comprising:

means for carrying metal slabs through the heating furnace;

at least one fossil-fuel operated burner for heating the metal slabs;

a convection zone without burners, wherein the metal slabs are heated primarily by convection heat delivered by combustion gases driven therethrough;

a heating zone, wherein the metal slabs are heated primarily by radiation heat emitted by the fossil-fuel operated burner located therein; and at least one active radiant heater which is positioned at a location before said fossil-fuel operated burner in an advancing direction of the metal slabs.

9. The elongated heating furnace as set forth in claim 8, wherein the radiant heater is positioned at a location, in which the depthwise temperature gradient of a metal slab begins to grow.

10. The elongated heating furnace as set forth in claim 8, wherein the radiant heater is located below the metal slabs.

11. The elongated heating furnace as set forth in claim 8, wherein said radiant heater comprises a resistance element transforming electric energy into heat or a combustion tube to be heated from inside by a burner.

12. The elongated heating furnace as set forth in claim 11, wherein the radiant heater is provided with a case, for protecting the resistance element from combustion gases.

13. The elongated heating furnace as set forth in claim 8, wherein the heating power of the radiant heater is adjusted on a basis of a surface temperature of the metal slabs.

14. The elongated heating furnace as set forth in claim 11, wherein the electric resistance elements are made of ceramics.

15. The elongated heating furnace as set forth in claim 14, wherein the radiant heater comprises a plurality of resistance elements placed one above another and a supporting frame for carrying said resistance elements.

16. The elongated heating furnace as set forth in claim 11, wherein the radiant heater includes a switch box to be ventilated by means of a fan, said resistance elements extending from said switch box into the heating furnace.

17. The elongated heating furnace as set forth in claim 11, wherein the resistance element is a resistance strip suspended in the heating furnace.

18. The method of claim 1, wherein the heating by the radiant heater reduces depthwise temperature differences developing in the metal slab.

19. The method of claim 1, wherein the step of heating by the radiant heater increases a capacity of the heating furnace.

20. The method of claim 18, wherein the step of heating by the radiant heater increases a capacity of the heating furnace.

21. The method of claim 1, wherein the heating by the radiant heater occurs in a transitional area between the convection zone and the heating zone.

22. The elongated heating furnace of claim 8, wherein the radiant heater is in the convection zone.

23. The elongated heating furnace of claim 8, wherein the radiant heater is in the heating zone.

24. The method of claim 8, wherein the radiant heater is in a transitional area between the convection zone and the heating zone.

25. The method of claim 12, wherein the case is a protective tube.

26. The method of claim 14, wherein the ceramics are $MoSi_2$.

* * * * *